United States Patent [19]

O'Brien

[11] 4,407,506

[45] Oct. 4, 1983

[54] GOLF TRAINING DEVICE

[76] Inventor: John P. O'Brien, 175 E. Delaware, Chicago, Ill. 60611

[21] Appl. No.: 350,999

[22] Filed: Feb. 22, 1982

[51] Int. Cl.[3] ..... A63B 69/36; A43B 5/00

[52] U.S. Cl. ..... 273/187 B; 36/127; 36/67 A

[58] Field of Search ..... 36/67 R, 67 A, 67 D, 36/127, 134; 273/35 R, 187 B, 188 A, 32 C

[56] References Cited

U.S. PATENT DOCUMENTS 2,336,632 12/1943 Park ..... 36/67 D 4,145,055 3/1979 O'Brien ..... 273/187 B

*Primary Examiner*—George J. Marlo

*Attorney, Agent, or Firm*—Donald E. Egan

[57] ABSTRACT

A golf training device, preferably simulating a conventional golf ball with respect to size and shape, is provided with an opening to receive the shank of a specially designed spike in order to removably attach the training device to a golf shoe. A specially designed spike has a cylindrical shank with at least one annular rib, spaced from the flange portion, which functions to frictionally engage the training device to the golf shoe spike.

7 Claims, 4 Drawing Figures

10
12
14
16
18
20
22
24
26
28
29
30

GOLF TRAINING DEVICE

The present invention relates to a golf training device and more particularly to a golf training device which may be readily attached to and readily removed from a conventional golf shoe, when equipped with a special spike. The golf training device of the present invention thus enables a golfer to practice his golf swing using the training device, but to readily remove the golf training device when playing a golf course.

BACKGROUND OF THE INVENTION

It is well known that most individuals could play an improved game of golf if they could develop a proper and consistent swing. Books and articles have been written on the proper form of a golf swing, but simply reading a book or article on how to strike a golf ball does not inherently provide a golfer with a proper and consistent swing, nor does it provide him with the feel of a proper and consistent swing. One of the major shortcomings in the swing of golfers, and particularly among the high handicap golfers, is the tendency to sway off the ball, and away from the intended target, during the backswing and subsequent failure to return to the proper position over the ball during the downswing. This fundamental error in the swing results in the golfer swinging from his rear foot, which frequently results in a slice, a topped shot, a smothered, duck hook and other mishit shots which will be known to those having the ordinary skill in the art.

It has been recognized by golfers and particularly by golf teachers or professionals that the tendency to sway off a ball, away from the intended target, can be reduced if a golfer's rear foot (the foot furthest from the target) is canted or tilted toward the target. The canting of the rear foot toward the target serves as a reminder to the golfer to stay over the ball during the backswing. Canting the rear foot will tend to force the golfer to keep his weight on the inside edge of his rear foot and thus tend to reduce the chances that the golfer will transfer all his weight to the rear foot. Canting the rear foot toward the target will permit the golfer to transfer 60 or 70% of his weight to the inside edge of the rear foot, but will result in a substantial portion of the weight remaining on the front foot even during the backswing. When the golfer's weight is thus distributed, he is able to shift his weight to the front foot during the downswing and at the same time maintain a steady head position over the ball.

In order to accomplish the canting of the rear foot toward the target, various devices have been devised. Initially, some golf teaching professionals simply suggest that their pupils place a golf ball under the outside edge of the rear foot. While such an expedient can be used to provide a suitable amount of canting of the rear foot, every time the golfer wishes to reposition his rear foot, it is necessary to reposition the golf ball under the shoe.

The prior art has suggested the use of golf shoes wherein one or both of the shoes are canted. In particular one U.S. patent suggests that the rear foot be equipped with a shoe which is canted toward the target. However, this patent describes a shoe which is permanently raised along its outer edge. While this might achieve some of the objectives of the present invention, insofar as giving the golfer the feel of a correct swing, such golf shoes are not adapted to conversion into an ordinary set of golf shoes. Further, walking substantial distances with one shoe canted would probably be uncomfortable and might cause orthopedic problems.

Applicant's U.S. Pat. No. 3,218,734 describes a removable supporting attachment for golf shoes, wherein the removable support is adapted to be affixed to a specifically designed spike or cleat, inserted for the purpose of holding the support attachment. While this device was successful in giving a golfer the correct feel of a proper golf swing, and had the advantage of being removable, the means for attaching the support device required the use of a special spike or cleat which had certain inherent limitations.

Applicant's U.S. Pat. No. 4,145,055 describes a golf training device which is affixed to a standard golf shoe spike by a magnet. The golf training device described in the '055 patent was very effective in providing a device which could be readily attached to a conventional golf shoe spike and detached therefrom as desired. However, the fabrication of a magnet with sufficient magnetic force to hold the training device to the spike proved to be expensive and presence of any dirt or the like on the golf spike or the golf training device substantially reduced the magnetic gripping power of the golf training device for the spike. Moreover, as golf shoes wear, the spikes tend to embed in the leather of the shoe sole which tends to interfere with the magnet's ability to affix the training device to the shoe. Consequently under field conditions, the golf training device of U.S. Pat. No. 4,145,055 did not always adhere well to the spike.

The improved golf training device of the present invention overcomes the disadvantages of the prior art wherein a golf ball shaped supporting member is temporarily affixed to a specially designed spike adapted to be screwed into a conventional golf shoe using the standard threads used for conventional spikes. The lower end of the special spike is generally cylindrical with an annular rib disposed about the cylinder which provides a frictional engagement of the support member of the special spike. In the preferred embodiment, the supporting member, i.e., the canting device per se is the approximate size and shape of a golf ball, i.e., the present invention contemplates the supporting device being a golf ball simulation with respect to size and shape, i.e., spherical in shape with a diameter of about 1.68 inches as is shown in the drawings. The use of the conventional golf ball shape and size for the support member is advantageous with respect to storing the golf training device in the usual environment in which golf balls are stored. The canting or support device has a radial opening to receive the spike and adapted to engage the ribs of the spike when the support is brought into position. The preferred canting device or support structure, in addition to being shaped to simulate a golf ball generally, has a concave surface surrounding the spike opening adapted to complement the shape of the flange of the spike.

The present invention thus provides a golf training device adapted to cant the rear foot into the desired attitude, which device may be readily attached to a conventional golf shoe and readily be removed therefrom, but which will remain in place during practice session. The only alteration required to the standard golf shoe is the replacement of one or more of the conventional golf spikes with the special spike shown and described herein. After the practice has been completed, the training device may be readily removed from the spike and stored in the golf bag or other golf ball storage devices. The specially designed spike may be removed from the golf shoe if desired, but preferably it is simply left in place.

The advantages of the present invention become apparent from the following specification and the claims and from the accompanying drawing, wherein:

Figures 1, 2, 3, 4:
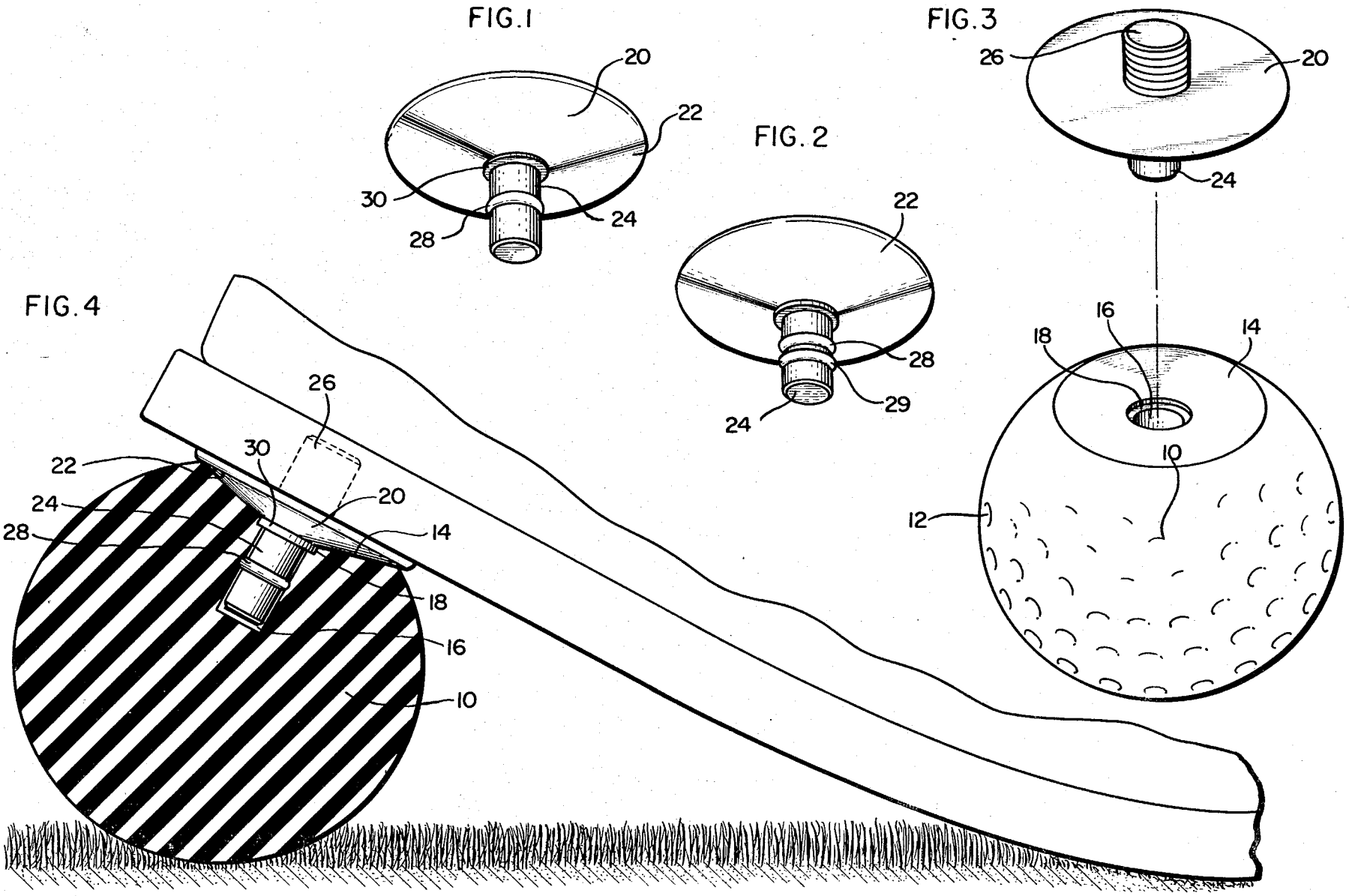
FIG. 1 is an isometric view of the specially modified golf spike of the present invention.
FIG. 2 is an isometric view of another embodiment of the modified golf spike of the present invention.

FIG. 3 is an isometric view of the golf training device of the present invention showing the golf ball-shaped support member in position beneath the modified spike of the present invention; and FIG. 4 is a cutaway view of the golf training device of the present invention showing the golf ball-shaped support member in place on the specially designed spike, which is threadly engaged in a conventional golf shoe sole.

The golf training device of the present invention, generally, comprises the supporting member shown generally at 10 (see FIG. 4) in combination with a specially designed spike 20, which is shown in FIGS. 1, 3 and 4.

In the preferred embodiment, the supporting member 10 is spherical in shape with a diameter of about 1.68 inches, as is shown in the drawing. This diameter approximates the size of a conventional USGA approved golf ball and is preferred because support structures of this size can be stored in conventional golf ball storage devices for facility. For example many golf carts and/or golf bags have specific containers, pockets or clips designed to hold golf balls and adapted to hold support devices of the present invention. As is shown in FIG. 3, the outer surface of the supporting device may be dimpled and the outer surface painted white, again to simulate the appearance of a golf ball.

The golf ball simulating support member may be made of any desired material, such as metal, plastic, or rubber. If desired, a "one-piece" golf ball can be adapted by boring the necessary hole therein.

One aspect of the support member 10 includes a radial opening or well 16 adapted to receive spike 20. As is shown in FIG. 4, well 16 desirably exceeds the length of spike 20. Concentrically disposed about well 16 is concave depression 14 adapted to complement the flange of the spike and annular cut-out 18 adapted to complement the shoulder of the spike, described below. The concave depression 14 and the annular cut-out 18 are optional, but desired in that they provide for a better engagement and a larger contact surface between the supporting member 10 and the spike 20.

As can be seen clearly from FIG. 1, the spike 20 generally includes flange 22, which is similar to or identical to a flange on a conventional golf spike, and a cylinder shaped barrel 24, which is modified from the conventional style spike. Threaded portion 26 of spike 20 is similar or identical to a conventional golf spike. Modified barrel 24 is preferably cylindrical in shape, rather than being tapered to a point as found in conventional spikes. Moreover, barrel 24 is equipped with at least one annular rib 28 adapted to frictionally engage well 16 of supporting member 10. Annular shoulder 30 which surrounds the junction of barrel 24 and flange 22 may be present, depending upon the method of fabrication of the spike, but does not form per se any feature of the present invention.

A second embodiment of the special spike of the present invention is shown in FIG. 2, wherein flange 22 is affixed to barrel 24 which is fitted with a pair of annular ribs 28 and 29. The embodiment shown in FIG. 2 is preferable insofar as it provides for improved frictional engagement with well 16 of support member 10 and reduces the "wobble" between the spike and the supporting member. However, the embodiment shown in FIG. 2 is somewhat more expensive to manufacture.

The concave depression 14 of support member 10 is contemplated by the preferred embodiment, irrespective of whether the spike shown in FIG. 2 or FIG. 3 is employed. The concave depression 14 is generally preferred in order to provide a greater area of contact between support member 10 and the flange 22 of the spike. It is contemplated that the concave depression reduces the wobble between the spike and the supporting member. The greater area of contact thus provides for better support and reduced wear on the inside of well 16.

Those skilled in the art will understand that the shape of the support member may be varied over wide limits, although the spherical shape is preferred. Further, the support device may be made from a variety of materials, such as rubber, plastic, wood, or metal, and as was suggested above, the conventional one-piece golf ball may be modified through drilling or machining processes to conform to the requirements of the supporting member as described herein. It will also be apparent to those skilled in the art that the particular structure of the annular ribs 28 may be modified widely and the number varied in order to improve the frictional engagement of well 16 of support member with the spike.

If desired, the flange 22 of the spike 20 may be modified to match the size and shape of the spikes and flanges conventionally used on women's golf shoes. Such a modification is advantageous in what when used on a woman's golf shoe all spikes appear to be approximately the size, insofar as the flange would be the same size as the flange on the conventional woman's golf shoe spike. Alternatively, the flange may be omitted. However, because the threads in the openings in both woman's golf shoes and men's golf shoes are approximately the same, and the spikes may be interchanged. The special spikes manufactured for men's golf shoes may be used in women's golf shoes simply by threading the special spike into the threaded opening in the golf shoe sole. When used thusly, no modification to the support member is required and it may be used with either men's shoes or women's shoes.

The forms of invention herein shown and described are to be considered only as illustrative. It will be apparent to those skilled in the art that numerous modifications may be made therein without departure from the spirit of the invention or the scope of the appended claims.

I claim:

1. A golf training device adapted to be removably affixed to a golf shoe, said training device comprising:

a support member, said support member being substantially spherical with a diameter from 1.6 to 1.75 inches, and having a radially disposed well therein adapted to receive the shank of a golf shoe spike, and a golf shoe spike comprising a conventially threaded upper portion, a flange of conventional size and shape, and a lower shank portion, said shank portion being generally cylindrical in shape with at least one annular rib disposed thereon, said rib being spaced from said flange, said support member designed to cooperate with said spike and receive said shank portion in said well, said annular rib adapted to frictionally engage the supporting member to removably affix said supporting device to a golf shoe.

2. A golf training device as described in claim 1, wherein said support member includes a concaved depression axially disposed about said well, complementary to the surface shape of said flange.

3. A golf training device as described in claim 2, wherein said shank portion includes a plurality of annular ribs, said ribs being spaced from each other and spaced from said flange.

4. A golf shoe spike comprising:

a cylindrical, threaded upper portion adapted to engage the threads of a conventional golf shoe spike opening, a centrally located flange portion, attached to said upper portion and axially positioned thereto, and a lower shank portion, attached to said flange portion, coaxial with said upper portions, said shank portion being generally cylindrical in shape with at least one annular rib disposed thereon, said rib being spaced from said flange portion.

5. A golf shoe spike as described in claim 4, wherein said shank portion includes a plurality of annular ribs, said ribs being spaced from each other and spaced from said flange.

6. A golf shoe spike comprising:

a cylindrical, threaded upper portion adapted to engage the threads of a conventional golf shoe spike opening, and a lower shank portion, attached to said upper portion, coaxial with said upper portions, said shank portion being generally cylindrical in shape with at least one annular rib disposed thereon, said rib being spaced from said flange.

7. A golf shoe spike as described in claim 6, wherein said shank portion includes a plurality of annular ribs, said ribs being spaced from each other and spaced from said flange.

* * * * *